United States Patent [19]

Jordan

[11] Patent Number: 4,930,784

[45] Date of Patent: Jun. 5, 1990

[54] PORTABLE PUTTING WAFFLE GREEN

[76] Inventor: Rodney B. Jordan, P.O. Box 39, Florien, La. 71429

[21] Appl. No.: 413,626

[22] Filed: Sep. 28, 1989

[51] Int. Cl.[5] ..... A63B 57/00; A63B 69/36

[52] U.S. Cl. ..... 273/178 B; 273/195 A; 273/176 J; 273/176 H; 428/17

[58] Field of Search ..... 428/17, 16; 273/34 R, 273/176 R, 176 FB, 176 J, 178 B, DIG. 13, 176 H, 195 A

[56] References Cited

U.S. PATENT DOCUMENTS

| | | | |
|---|---|---|---|
| 2,465,418 | 3/1949 | Baker | 273/176 H |
| 2,515,847 | 7/1950 | Winkler | 428/17 |
| 3,139,283 | 6/1964 | Lester | 273/195 A |
| 3,143,350 | 8/1964 | Lester | 273/195 A |
| 3,423,096 | 1/1969 | Tone | 273/195 A |
| 3,534,961 | 10/1970 | Tiley | 273/176 H |
| 3,892,412 | 7/1975 | Koo | 273/176 H |
| 4,017,084 | 4/1977 | Jeffery | 428/17 X |
| 4,396,653 | 8/1983 | Tomarin | 428/17 |
| 4,535,021 | 8/1985 | Friedrich | 428/17 X |

*Primary Examiner*—Henry F. Epstein
*Attorney, Agent, or Firm*—Rod Bryant Jordan

[57] ABSTRACT

A portable, artificial putting green capable of being deployed over a variety of surfaces, so constructed as to take on the shape of the underlying surface on which it is placed.

12 Claims, 3 Drawing Sheets

PORTABLE PUTTING WAFFLE GREEN

BACKGROUND OF THE INVENTION

The present invention relates to an apparatus for use as a portable, realistic, artifical putting green.

DESCRIPTION OF THE PRIOR ART

The sport of golf is becoming more and more popular. Being a game of skill, practice is of extreme importance, especially in the short game. Putting is one area of the game which many golfers believe requires extensive practice. Putting practice is, however, usually limited by lack of a proper putting surface. One can drive, pitch or chip in a pasture or yard, however, putting requires a particular type of surface, a surface which exhibits all of the features of a real putting green.

Perhaps the most common attempt to solve this problem is to put on carpet, into an elevated portable pin hole. The major problems with this approach are the facts that the momentum required for the ball to climb into the elevated portable pin hole is enough to send the golf ball directly over the top of the pin hole in a real putting situation, and secondly, that carpet is usually flat, and therefore gives no practice in regard to reading greens or putting on unlevel surfaces. Putting carpet strips with built in pin holes, are available, however they do not offer variable putting situations. It is, therefore, the purpose of this invention to provide an artificial putting green with a realistic putting surface, realistic pin holes, a high degree of portability and unlimited putting variations.

SUMMARY OF THE INVENTION

The invention as set forth comprises a suitably sized piece of Astroturf or other simulated grass mat, probably rubber backed, with a special support layer underneath. The support layer must be thick enough to allow for a sufficient drop as the ball enters the pin hole. It must be firm enough to walk on without making a depression or bulge and it must be flexible enough so that the putting green will take on the surface features of the ground or other surface on which it is lain. One way to get these features in a support layer is to line the underside of the mat with a waffle like layer of individual supports. These supports could be formed in a variety of shapes. They would be fastened to the underside of the mat, adjacent to one another in straight or perhaps staggered rows. They would be tapered toward the bottom as to resemble an upside down pyramid, with the top of the summit of the pyramid flattened off. This would allow the support layer to flex in all directions, therefore contouring to the surface on which it is lain. Three sided pyramids, cones or square based cones could also be used as long as they are fastened to the mat with their sides adjacent. For the purpose of this brief description, the supports will be considered to be inverted pyramids.

The flat surface at the summit of the pyramids should be small enough to allow the pyramids to penetrate the grass (in the case of lawn use), yet large enough to support a golfers weight without penetrating the soil or otherwise damaging the underlying surface. Each pyramid should be small enough at its base (the surface fastened to the bottom of the mat) so that the flat surfaces on the green directly above each pyramid will be negligible in ares. The pyramids could be elastically attached to the underside of the mat in order to help in avoiding this problem, thus allowing the mat to flex, even above the pyramid base. The base of each pyramid could be concave, and the mat attached to the base only at the corners of the base. This would allow the mat to bend in a concave or convex shape over the top of the base, eliminating the flat area. If the support layer were made up of inverted cones, rather than pyramids, the concave bases of the cones would allow the mat to flex uniformly, even if the entire perimeter of the bases were fastened to the mat. Another way to avoid flat areas above the base of the pyramids is to incorporate a thin layer of soft, stretchable, perhaps foam like material between the pyramid bases and the mat.

Any number of pin holes could be suitably formed into the green. The pyramid supports could be made of any of a variety of materials such as styrofoam plastic or rubber. Many artificial turf materials are rubber backed. The pyramid supports could also be rubber. If the pyramid supports are made of the same material as the artificial turf backing, the pyramid supports could be molded as a part of the backing itself, therefore eliminating a step in manufacturing. Materials for construction should be chosen so that the putting green would be heavy enough to force the supports to penetrate down to a firm surface, yet light enough to be rolled up and transported easily.

The above described green could be rolled up or folded for storage or shipping. Once rolled out, it would take on the contour of the underlying surface, thus providing for convenient putting practice on a realistic green of unlimited variation.

DETAILED DESCRIPTION OF THE INVENTION

Figure 1:
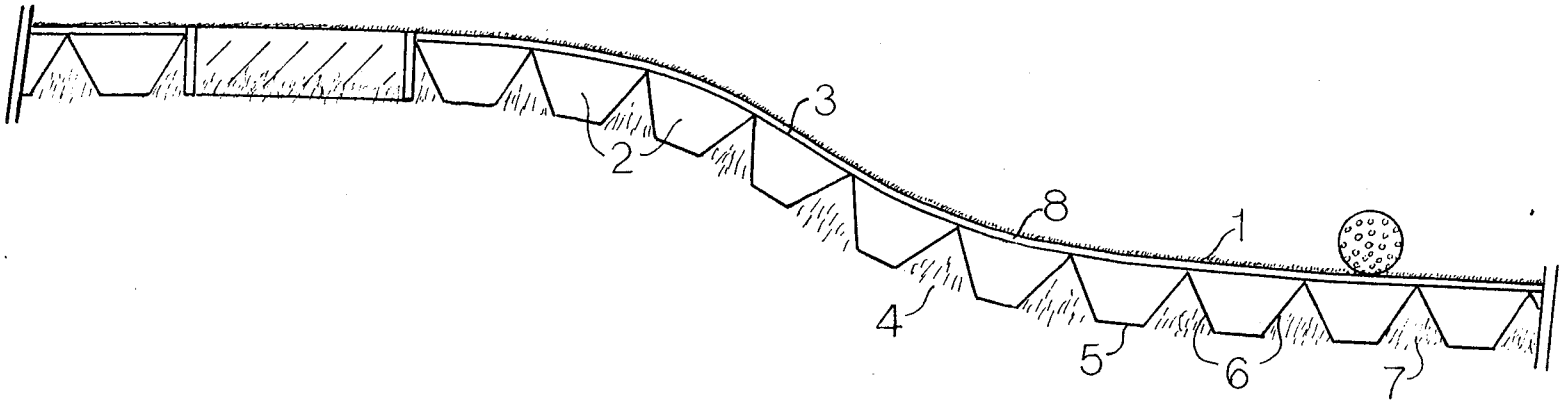
FIG. 1 is a cutaway of the Waffle Green in use, showing several pyramid shaped individual supports and a pin hole.

Referring now to the drawings, and more particularly to FIG. 1, it can be seen that a suitably sized piece of artificial turf mat 1 is fitted with a plurality of pyramid shaped individual supports 2. The upper surfaces 3 of the individual supports 2 are fastened to the underside of the artificial turf 1. The pyramid shaped individual supports 2 are therefore inverted pyramids, and thus point toward the underlying surface 4, in this case, a lawn. The summits of the pyramids forming the individual supports 2 are flattened off, forming a lower surface 5. This provides adequate support, and prevents the supports 2 from damaging the underlying surface 4. The underside of the artificial turf 1 is covered with supports 2, in such a way that the sides 6 of the bases of the supports 2 are adjacent to one another. This provides for uniform support throughout the putting surface. The fact that the sides 6 of the supports 2 are tapered way from each other allows the artificial turf 1 to flex in any direction, thus conforming to the shape of the underlying surface 4. Where the putting green is used over a lawn, the tapering of the supports 2 also allows each support to penetrate the grass 7, therefore reaching a firm surface, while doing little damage to the grass. This provides for a good firm putting surface. In the design depicted in FIG. 1, the supports 2 are connected by and molded as a part of the artificial turf backing 8.

Figure 2:
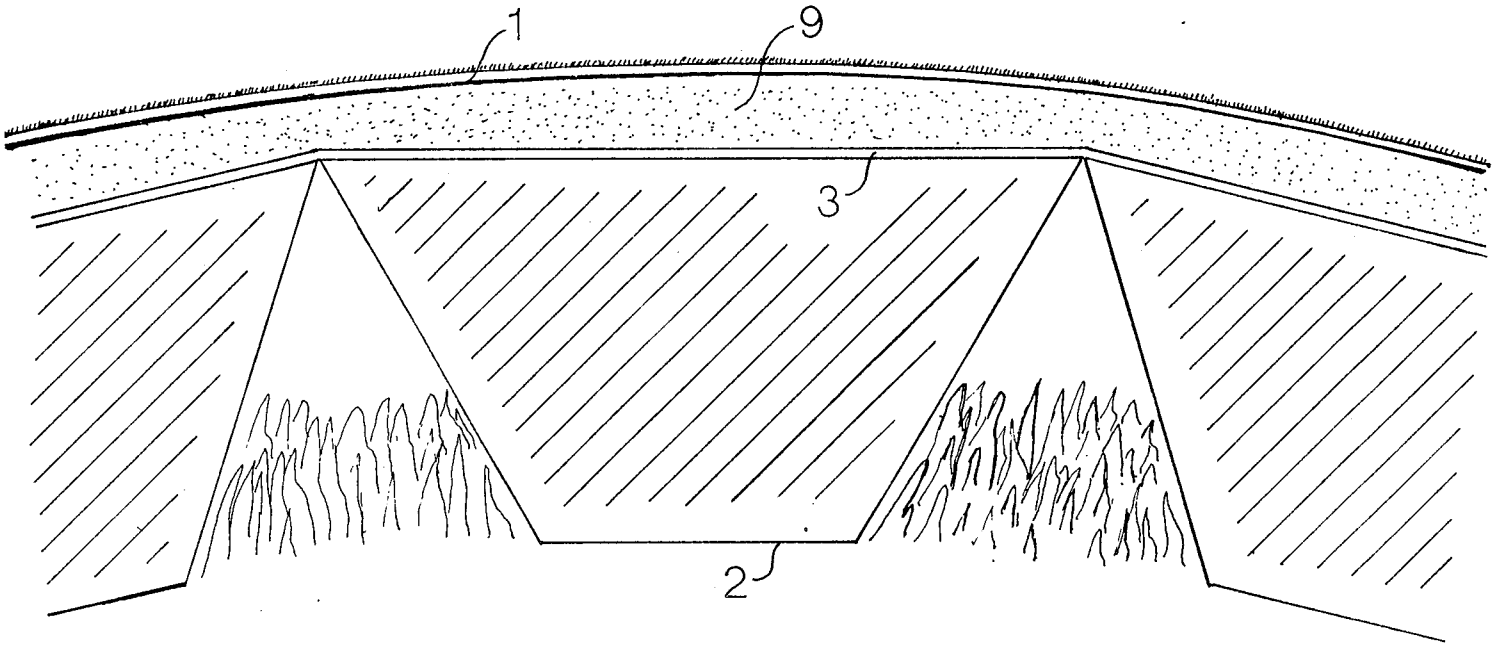
FIG. 2 is an elevation view of a pyramid shaped individual support as attached to the mat.

Referring to FIG. 2, it can be seen that a piece of stretchable foam like elastic material 9 is present between the upper surface 3 of each individual support 2 and the underside of the artificial turf mat 1. This allows the artificial turf mat 1 to flex above each individual support 2. The stiffness of the artificial turf mat 1 forces the elastic material 9 to stretch, or be compressed in the appropriate places. This provides for a near perfect contour. In this illustration, the putting green is placed upon a convex surface. If the putting green were placed upon a concave surface, a similar result would occur.

Figure 3:
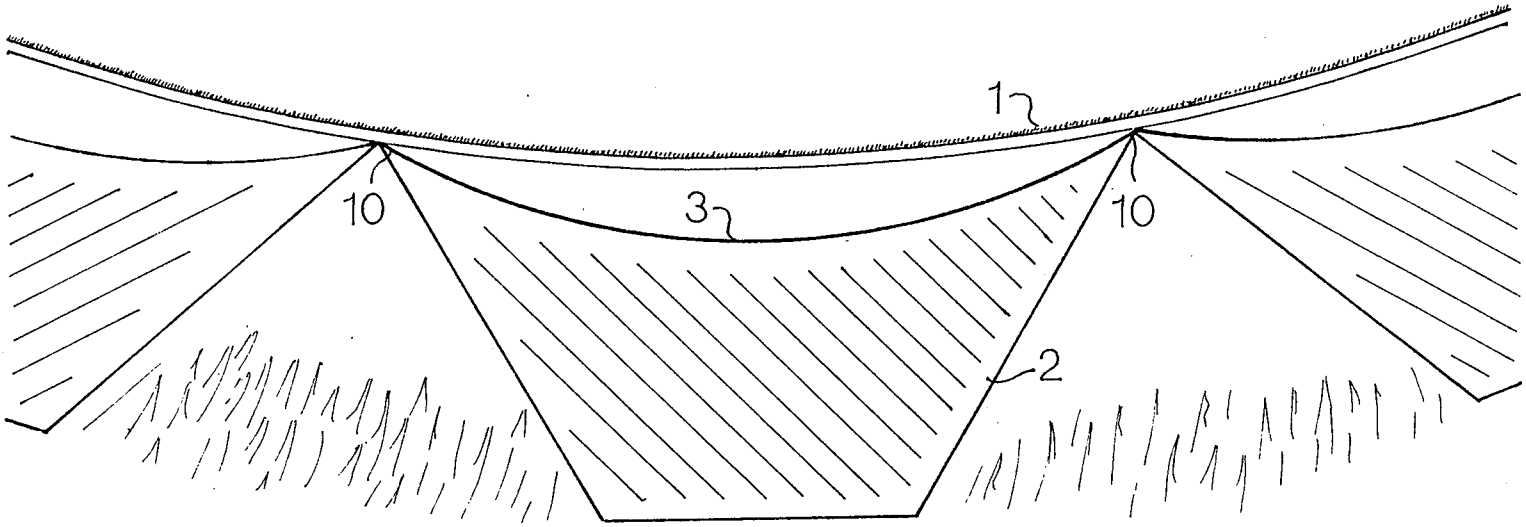
FIG. 3 is an elevation view of a pyramid shaped individual support attached to a mat, the attached surface being concave in shape.

Referring to FIG. 3 it can be seen that an individual support 2 is attached to the artificial turf mat 1 only at the individual support's corners 10. It can also be seen that the upper surface 3 of the individual support 2 is concave in shape. This allows the artificial turf mat 1 to bend in any direction over the top of the support 2. The stiffness of the artificial turf mat 1 causes the mat to bend in smooth curves, thus eliminating flat areas, and providing for a more perfect contour. In this illustration the putting green is placed upon a concave surface. If the putting green were placed upon a convex surface, a similar result would occur.

In is thought to be apparent, given the forgoing description, that this invention will provide for an artificial putting green wiht a realistic putting surface, realistic pin holes, a high degree of portability, and unlimited putting variations. It is also thought apparent that such an artificial putting green would provide for countless hours of valuable practice and enjoyment.

I claim:

1. A portable, artificial putting green comprising;

a. an artificial simulated grass mat, said mat having an upper and under side; and b. a support layer formed to said under side of said mat, said support layer further comprising a plurality of individual supports, said supports suitably arranged and shaped as to allow said mat to conform to the underlying surface.

2. A portable, artificial putting green as recited in claim 1, wherein each said individual support has an upper and lower surface, and wherein said upper surface of each said individual support is fastened to said under side of said mat in such an arrangement that said individual supports will be adjacent to one another, and wherein said individual supports have sides, said sides being tapered from said upper surface to said lower surface, so as to allow said mat to flex in all directions.

3. A portable, artificial putting green as recited in claim 2, being deployed over a lawn, wherein said lower surfaces are sufficient in area so as to support a golfers weight without penetrating the soil, yet small enough in area to penetrate the grass under the weight of said putting green.

4. A portable, artificial putting green as recited in claim 3, wherein said mat has a reinforcing backing formed of a particular material, and wherein said individual supports are formed of the same material as said backing, said individual supports being formed into, and a part of said backing.

5. A portable, artificial putting green as recited in claim 2, wherein a layer of elastic material is present between said individual supports and said under side of said mat, so as to allow said mat to flex above said upper surfaces of said individual supports.

6. A portable, artificial putting green as recited in claim 2, wherein each said individual support is elastically attached to said mat.

7. A portable, artificial putting green as recited in claim 2, wherein said upper surfaces of said individual supports is concave in shape.

8. A portable, artificial putting green as recited in claim 7, wherein said upper surfaces of said individual supports in circular.

9. A portable, artificial putting green as recited in claim 7, wherein each said upper surface of said individual supports has a plurality of corners, and wherein each said upper surfaces of said individual supports is attached to said mat only at said corners.

10. A portable, artificial putting green as recited in claim 2, wherein said individual supports further comprise inverted cones.

11. A portable, artificial putting green as recited in claim 3, wherein said individual supports further comprise inverted cones.

12. A portable, artificial putting green, for use on various underlying surfaces, said putting green comprising an artificial turf mat, said mat having an upper and under side, a support layer comprising a plurality of individual supports being suitable adhered to said under side, and one or more pin holes formed into said putting green, said support layer being sufficient in thickness to accommodate said pin holes, said support layer being so constructed as to allow said support layer to flex in any direction, thus allowing said putting green to conform to said underlying surfaces.

* * * * *